United States Patent [19]

Burnett et al.

[11] Patent Number: 4,930,314

[45] Date of Patent: Jun. 5, 1990

[54] STIRLING CYCLE MACHINE

[75] Inventors: Sibley C. Burnett, Cardiff by the Sea; John R. Purcell; William P. Creedon, both of San Diego, all of Calif.; Chandrashekhar H. Joshi, Bedford, Mass.

[73] Assignee: CDC Partners, San Diego, Calif.

[21] Appl. No.: 404,605

[22] Filed: Sep. 8, 1989

[51] Int. Cl.[5] ..... F02G 1/04

[52] U.S. Cl. ..... 60/517; 60/526

[58] Field of Search ..... 60/517, 526; 62/6

[56] References Cited

U.S. PATENT DOCUMENTS 3,827,675 8/1974 Schuman ..... 60/517

4,490,974 1/1985 Colgate ..... 60/517

*Primary Examiner*—Allen M. Ostrager

*Attorney, Agent, or Firm*—R. Gale Rhodes, Jr.

[57] ABSTRACT

Improved Stirling cycle machine including at least a pair of eccentric disks fixed to a pair of rotatable shafts in phase with each other and which eccentric disks upon rotation of the shafts (in opposite directions in the preferred embodiment) also rotate (in opposite directions in the preferred embodiment) and impart upward movement to a bellows defining a variable-volume compression or expansion chamber with a reduced tendency to also impart side thrust, rocking motion, or lateral movement to the bellows whereby bellows wear is reduced and the life of the bellows and the Stirling cycle machine is increased.

9 Claims, 4 Drawing Sheets

STIRLING CYCLE MACHINE

BACKGROUND OF THE INVENTION

This invention relates generally to a new and improved Stirling cycle machine, and more particularly relates to a new and improved Stirling cycle machine providing increased accessibility to the coldest internal portion of the machine and decreased wear of the bellows providing the variable volume compression and expansion chambers of the machine.

As known to those skilled in the art, Stirling cycle machines employ the well known Stirling cycle to provide very low temperatures for cooling objects such as, for example, electronics. As is further known, Stirling cycle machines include variable-volume compression and expansion chambers interconnected by a regenerator for conducting gas between the chambers. Some prior art Stirling cycle machines use pistons and cylinders to provide the variable-volume compression and expansion chambers while other prior art Stirling cycle machines use bellows to provide the variable-volume compression and expansion chambers. The Stirling cycle machines using the bellows also use driving means for imparting upward movement to the bellows to compress the chambers which chambers are compressed and expanded out of phase with each other, for example 90° out of phase.

As is still further known to those skilled in the art, in the typical prior art Stirling cycle machine utilizing such bellows, the bellows are driven by eccentric drive means which impart upward movement to the bellows to compress them, but it has been found that such prior art eccentric drive means typically also unwantedly impart at least some rocking motion, side thrust, or lateral movement to the bellows along with the upward movement which undesirably increases the wear of the bellows and unwantedly shortens the life of the bellows and thereby the life of the Stirling cycle machine. It has been found that even when the bellows are contained within a tube or cylinder for restricting the bellows movement generally to upward movement, there is still at least a tendency with the prior art eccentric bellows drive to also impart at least some rocking motion, lateral side thrust or lateral movement to the bellows which causes undesired increased wear of the bellows and unwanted shortened machine life. Shortened bellows life and therefore shortened machine life is a problem attendant to the typical prior art Stirling cycle machine employing eccentric bellows drive means.

As is further known to those skilled in the art, the regenerator of a Stirling cycle machine is said to have a hot end and a cold end and the coldest internal portion of the Stirling cycle machine is the cold end of the regenerator which is connected to the expansion bellows providing the variable-volume expansion chamber. Further, typically, the connection of the cold end of the regenerator to the bellows providing the variable-volume expansion chamber is buried deep within the interior of the Stirling cycle machine making the cold end of the regenerator extremely inaccessible for the mounting thereto of an object to be cooled such as the above-noted electronics. This inaccessibility is also a problem attendant to the prior art Stirling cycle machines.

An example of a prior art Stirling cycle machine using bellows to provide the compression and expansion chambers is disclosed in U.S. Pat. No. 4,619,112, patented Oct. 28, 1986, Stirling A. Colgate inventor. The Stirling cycle machine disclosed in this patent includes compression and expansion chambers which may each comprise an isothermal bellows disclosed in U.S. Pat. No. 4,490,974, patented Jan. 1, 1985, Stirling A. Colgate inventor. The above-noted prior art problems attendant to the typical prior art Stirling cycle machine may be better understood by reference to FIG. 8 of the U.S. Pat. No. 4,490,974; in FIG. 8 of this patent, it will be noted that the bellows defining the compression chamber 1 is driven by a single eccentric including a crank 6 mounted on the rotatable shaft 8 and that the bellows defining the expansion chamber 2 is driven by a pair of eccentrics including crank arms 7 also mounted on the rotatable shaft 8. Thus, it will be understood that in this prior art Stirling cycle machine bellows eccentric driving mechanism, even though the eccentric driving apparatus are confined within structure to cause them to impart upward movement to the bellows, since the drives are eccentric drives, there is at least a tendency to impart at least some side thrust, rocking motion, or lateral movement to the bellows along with the upward movement.

Further, as is illustrated in FIG. 8 of the U.S. Pat. No. 4,490,974, the coldest internal portion of the machine, that is the cold or upper end of the regenerator 3, is buried deep within the interior of the machine with the cold or upper end of the regenerator 3 being connected to the bottom portion of the expansion chamber 1 also buried deep within the interior of the Stirling cycle machine. This deep burying makes it extremely difficult to mount and remove objects to be cooled. Accordingly, there exists a need in the Stirling cycle machine art for increased accessibility to the internal portion of the machine where the cold end of the regenerator connects to the bellows providing the variable-expansion chamber, and for improved eccentric drive means reducing bellows wear wherein the upward movement imparted to the bellows is imparted with at least a reduced tendency of also imparting side thrust, rocking motion, or lateral movement to the bellows.

SUMMARY OF THE INVENTION

The object of the present invention is to provide a new and improved Stirling cycle machine which solves the above-noted problems typically attendent to prior art Stirling cycle machines.

A new and improved Stirling cycle machine satisfying the foregoing object and embodying the present invention may include at least a pair of eccentric disks fixed to a pair of rotatable shafts in phase with each other and which eccentric disks upon rotation of the shafts (in opposite directions in the preferred embodiment) also rotate (in opposite directions in the preferred embodiment) and impart upward movement to a bellows defining a variable-volume compression or expansion chamber with a reduced tendency to also impart side thrust, rocking motion, or lateral movement to the bellows whereby bellows wear is reduced and the life of the bellows and the Stirling cycle machine is increased. A Stirling cycle machine embodying the present invention may further include first and second bellows respectively defining variable-volume compression and variable-volume expansion chambers mounted parallel to each other with the hot end of the regenerator connected to the first bellows and the cold end of the regenerator connected to the second bellows, for example, through a cold transfer plate, whereby enhanced accessibility is provided to the cold end of the regenerator which in turn enhances the ease of mounting an object to be cooled to, or closely adjacent, the cold end of the regenerator.

DESCRIPTION OF THE PREFERRED EMBODIMENT

Figure 2:
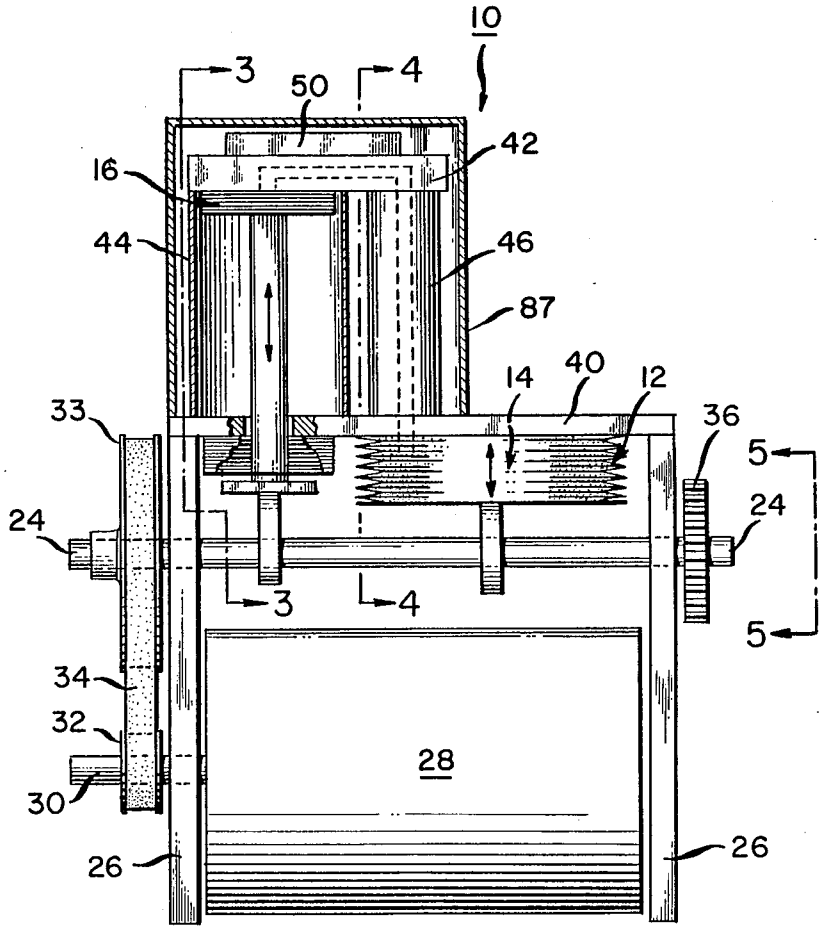
FIG. 2 is a side elevational view of the Stirling cycle machine of FIG. 1 with the right side portion of the housing removed to illustrate the internal structure of the machine.
Figure 1:
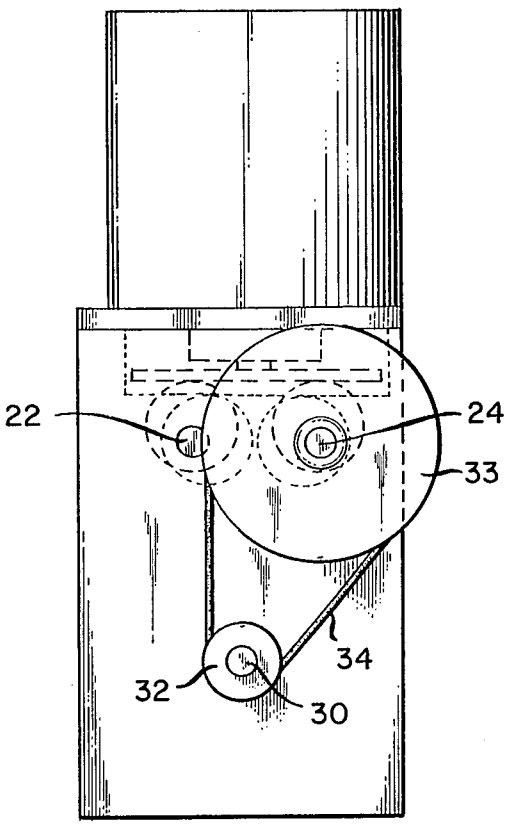
FIG. 1 is a front elevational end view of an improved Stirling cycle machine embodying the present invention.

Referring to the drawings, and in particular FIGS. 1 and 2, there is illustrated new and improved Stirling cycle machine embodying the present invention and indicated by general numerical designation 10. The machine 10 includes a first bellows 12 defining a variable-volume compression chamber 14, better seen in FIG. 4, and a second bellows 16 defining a variable-volume expansion chamber 18, better seen in FIG. 3. In FIG. 2, the bellows 16 is shown compressed and the bellows 12 is shown partially expanded.

Stirling cycle machine 10 further includes a pair of shafts 22 and 24, FIGS. 1, 3–5 mounted suitably for rotation in the frame 26—26, FIG. 2. A suitable motor 28 (FIG. 2) is included and is also suitably mounted to the frame 26—26. Mounted on the drive shaft 30 of the motor 28 is a pulley 32 and mounted on the front end of the shaft 24 is a pulley 33; a drive belt 34 engages the pulleys 32 and 33. Mounted to the rear end of the shaft 24 is a gear 36 which, as may be best understood from FIG. 5, meshes with a gear 38 mounted on the rear end of the shaft 22. Thus, it will be understood that upon the motor 28 imparting clockwise rotation to the drive shaft 30, clockwise rotation is imparted to the shaft 24 through the pulleys 32 and 33 and drive belt 34, and counterclockwise rotation is imparted to the shaft 22 through the gears 36 and 38 mounted on the rear ends of the shafts. Accordingly, it will be understood that upon the motor 28 being operated the shafts 22 and 24 rotate in opposite directions of rotation.

Figure 3:
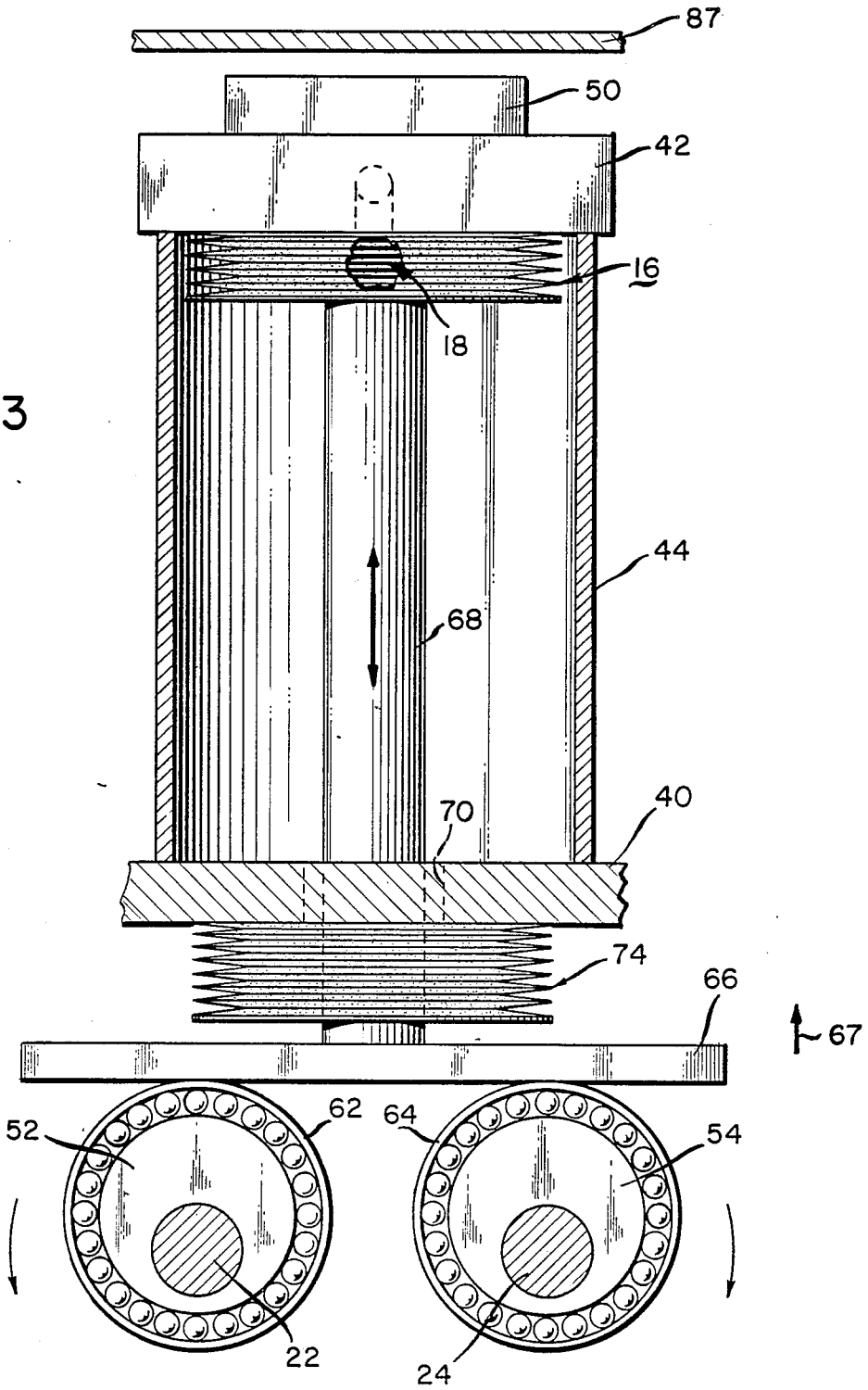
FIG. 3 is a transverse cross-sectional view taken generally along the irregular line 3—3 in FIG. 2 and in the direction of the arrows.
Figure 4:
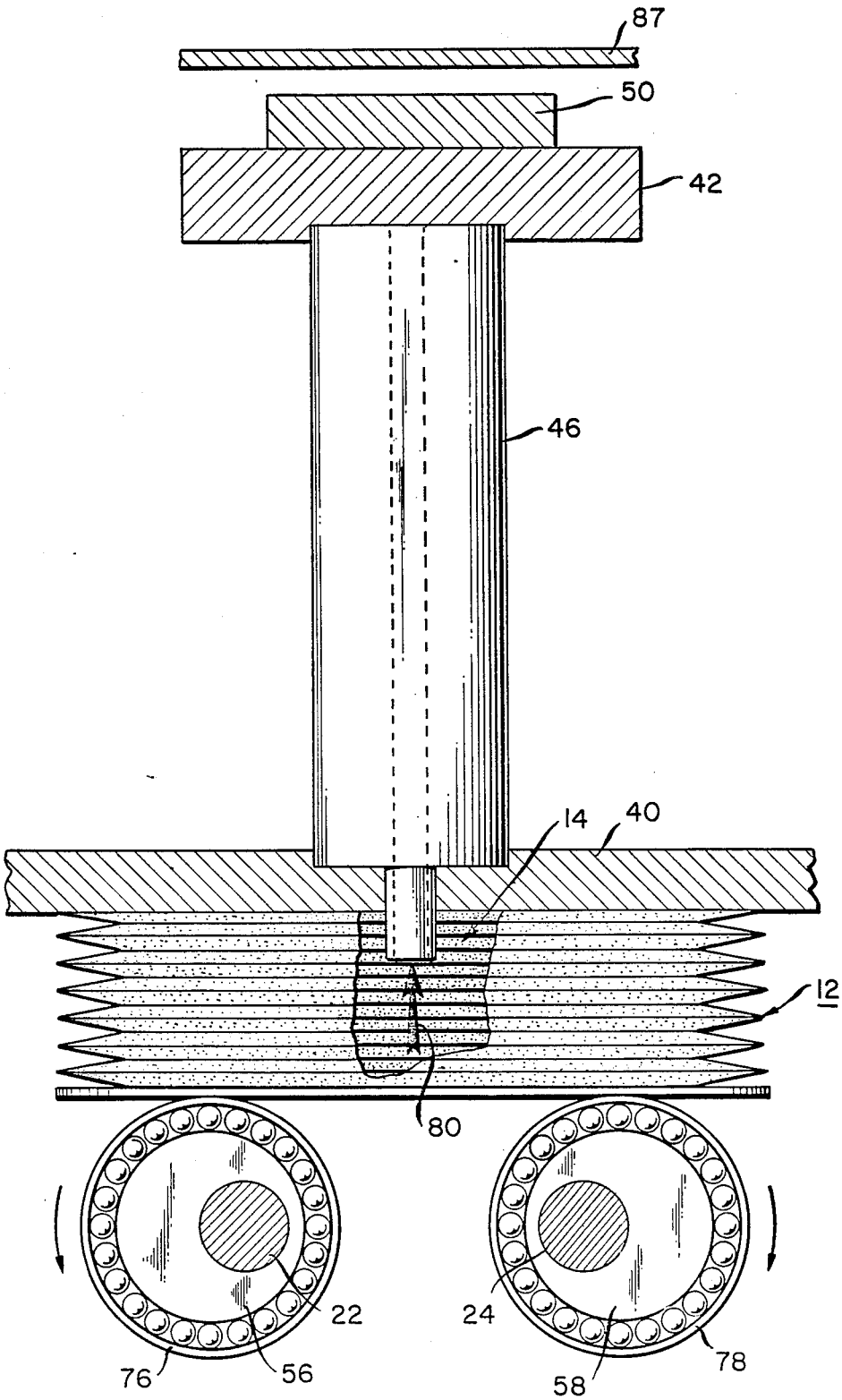
FIG. 4 is a transverse view taken generally along the line 4—4 in FIG. 2 and in the direction of the arrows.

It will be further understood, FIGS. 2–4, that the Stirling cycle machine 10 of the present invention further includes a stationary mounting plate 40 suitably mounted to the frame 26—26, and a cold transfer plate 42 mounted to the top of a support cylinder or tube 44 also mounted suitably to the mounting plate 40. It will be still further understood, particularly by reference to FIG. 2, that the fixed top end of the bellows 12 is suitably secured to the mounting plate 40 and that the fixed or top end of the bellows 16 is suitably secured to the cold transfer plate 42.

Further, as illustrated in FIG. 2, the Stirling cycle machine 10 of the present invention may include a suitable regenerator 46 having its hot or lower end suitably mounted to the mounting plate 40 and its cold or upper end suitably mounted to the cold transfer plate 42. The gas transfer path for the gas contained in the variable-volume compression-expansion chambers 14 and 16 is illustrated in dashed line in the upper portion of FIG. 2 and extends between the interiors of the bellows 12 and 16 and through an internal passageway provided in the regenerator 46.

The Stirling cycle machine 10 embodying the present invention, FIG. 3, may further include a first pair of eccentric disks 52 and 54 mounted fixedly on the shafts 22 and 24 in phase with each other but for being rotated in opposite directions of rotation by the respective shafts 22 and 24. In addition, the machine 10 may further include a second pair of eccentric disks 56 and 58, FIG. 4, mounted fixedly on the shafts 22 and 24 in phase with each other but for being rotated in opposite directions of rotation by the respective shafts 27 and 24. It will be further understood that the first pair of eccentric disks 52 and 54 are mounted on the shafts 22 and 24, in this preferred embodiment, 90° out of phase with the second pair of eccentric disks 56 and 58.

Figure 6:
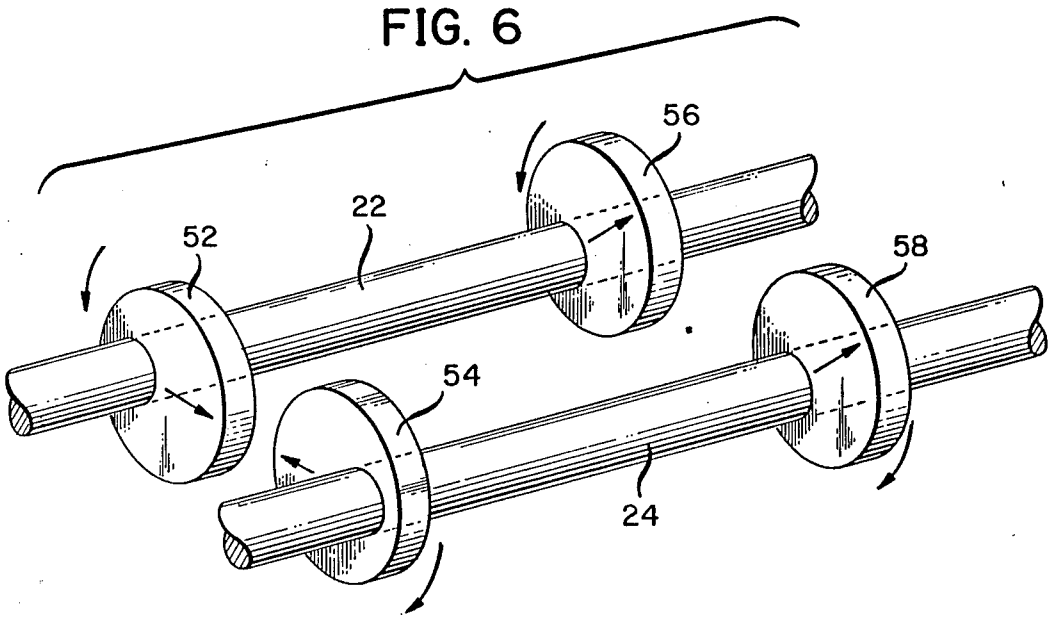
FIG. 6 is a diagrammatical illustration of the phase relationship between the eccentric disks of a pair thereof and the phase relationship between the pairs of eccentric disks.
Figure 5:
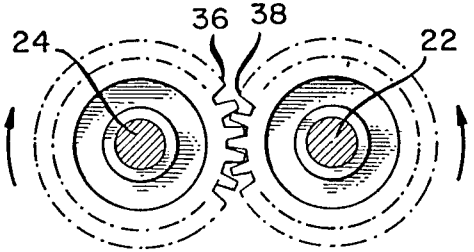
FIG. 5 is a view taken generally along the lines 5—5 of FIG. 2 in the direction of the arrows.

The phase relationships between the eccentric disks may be better understood by reference to FIG. 6 where the maximum radius of each eccentric disk 52 and 54, and 56 and 58, is indicated by the arrow shown thereon. By referring first to the arrows on eccentric disks 56 and 58, it will be understood that although these disks are rotating in opposite directions, the disks 56 and 58 present their maximum radii simultaneously to the bottom of the bellows 12 (FIG. 4) to compress the bellows and thus the disks 56 and 58 are in phase with each other. Similarly by referring to the maximum radii indicated by the arrows on the eccentric disks 52 and 54 in FIG. 6, it will be understood that these disks present their maximum radii simultaneously to the drive plate 66 (FIG. 3), and through the push rod 68 to the bottom of the bellows 16 and thus the eccentric disks 52 and 54 are in phase with each other. Further, by referring again to FIG. 6 and to the maximum radii represented by the arrows shown on the first and second pairs of eccentric disks 42 and 54 and 56 and 58, it will be understood that in the preferred embodiment the pairs of eccentric disks are 90° out of phase with each other, that is, the pair of eccentric disks 52 and 54 present their maximum radii to the bottom of the bellows 16 to compress the bellows 16 after the shafts 22 and 24 have rotated an additional 90° from the time the pair of eccentric disks 56 and 58 present their maximum radii to the bottom of the bellows 12 to compress the bellows 12.

As may be best understood by reference to FIGS. 3 and 4, the pairs of eccentric disks 52 and 54 and 56 and 58 are surrounded by annular ball bearing assemblies including inner and outer races. The outer races 62 and 64 of the annular ball bearing assemblies surrounding the eccentric disks 52 and 54 are for engaging and imparting upward movement to a drive plate 66 as indicated by the arrow 67 in FIG. 3 upon the shafts 22 and 24 and the eccentric disks 52 and 54 being rotated in opposite directions of rotation. A push rod 68 is suitably mounted to the top of the drive plate 66, FIG. 3, and the bottom movable end of the bellows 16 is mounted suitably to the top of the push rod 68 as is also illustrated in FIG. 3. As may be further understood from FIG. 3, the push rod 68 extends through an opening 70 formed in the mounting plate 40 and to seal this opening an additional bellows 74 may be provided with the upper end of the bellows 74 being suitably connected to the mounting plate 40 and with the bottom of the bellows 74 being suitably connected to the push rod 68 as illustrated in FIG. 3.

As may be understood by reference again to FIG. 4, the outer races 76 and 78 of the annular ball bearing assemblies surrounding the eccentric disks 56 and 58 are for engaging and impart upward movement to the bottom of the bellows 12 as illustrated by the arrow 80 in FIG. 4 upon the shafts 22 and 24 and the eccentric disks 56 and 58 being rotated in opposite directions of rotation.

Thus it will be understood, in accordance with one novel feature of the present invention, that by imparting upward movement to the bellows 12 and 16 with the respective pairs of eccentric disks 52 and 54 (FIG. 3) and 56 and 58 (FIG. 4) rotating respectively in phase but in opposite directions with much less side thrust, rocking motion, or lateral movement is imparted to the bellows than were the upward movement to be imparted to the bottoms of the bellows 12 and 16 respectively by a single eccentric. It will be still further understood that by surrounding the eccentric disks with the ball bearing assemblies as shown in FIGS. 3 and 4, and by imparting the upward movement to the drive plate 66 (FIG. 3) and the bottom of the bellows 12 (FIG. 4) through the outer races, the upward movement or force imparted through the outer races is done with reduced friction, and thereby with less side force, lateral movement, rocking motion, than were such upward movement to be imparted by direct engagement of the pairs of eccentric disk 52 and 54 and 56 and 58 with the drive plate 66 and the bottom of the bellows 12, respectively.

The other novel feature of the present invention, increased accessibility to the cold end of regenerator 46, best understood by reference to FIG. 2, will be explained. As illustrated particularly in FIG. 2, the bellows 12 and 16 are mounted parallel to each other with the regenerator 46 being mounted thereto as shown in FIG. 2 and described above. This structural arrangement provides increased accessibility to the cold or top end of the regenerator 46, and to the cold transfer plate 42, as compared to the cold end of the regenerator 3 illustrated in FIG. 8 of U.S. Pat. No. 4,490,974 as described above. Thus, an object to be cooled, for example electronics indicated diagrammatically by the block indicated by numerical designation 50, may be readily mounted internally of the improved Stirling cycle machine 10 of the present invention at, or in close proximity to, the cold upper end of the regenerator 46 and directly to the cold transfer plate 42, by merely removing the upper housing or tube 87 of the machine 10 with no other disassembly of the machine being required.

Figure 7:
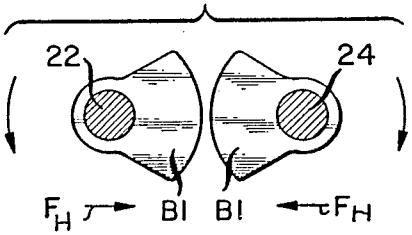
FIGS. 7 and 8 are diagrammatical illustrations of bob weights which may be used in the present invention.
Figure 8:
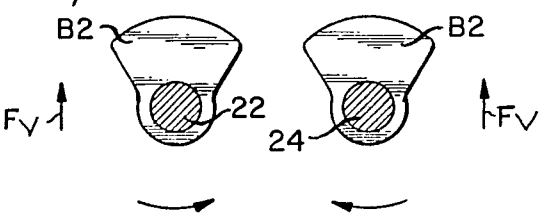

In accordance with the further teachings of the present invention, and referring to FIGS. 7 and 8, the shafts 22 and 24 may be provided with two sets of bob weights illustrated by set of bob weights B1 and B2, one set of bob weights mounted on the shafts 22 and 24 180° out of phase with the pair of eccentric disks 52 and 54 and the other set of bob weights mounted on the shafts 22 and 24 180° out of phase with the pair of eccentric disks 56 and 58. Upon the shafts 22 and 24 rotating in opposite directions in the preferred embodiment, illustrative set of bob weights B1 and B2 also rotate in opposite directions and, as illustrated in FIG. 8, exert horizontal forces $F_H$ on the shafts 22 and 24, and as illustrated in FIG. 8, exert vertical forces $F_V$ on the shafts 22 and 24, which forces $F_H$ and $F_V$ cancel the vertical forces imparted by the reciprocating masses driven by the eccentric disks, without imparting net horizontal forces to the machine 10. The bob weights provide an embodiment which is less subject to vibration and thereby further enhances the life of the improved Stirling cycle machine of the present invention.

It will be still further understood that the bellows 12 and 16 may be provided internally with what is referred to in the art as a puck to negative the dead volume effect attendant to bellows operation.

With further regard to the bellows 12 and 16, it will be understood that the pressure of the gas contained in these bellows causes them to expand upon their respective pairs of eccentric disks presenting their minimum radii to the bottom of the bellows.

Alternative to the preferred embodiment wherein the shafts 22 and 24 and pairs of eccentric disks 52 and 54 and 56 and 58 are rotated in opposite directions of rotation, it has been found that use of the two pairs of eccentric disks to impart upward movement to the bottoms of the bellows 12 and 16 through the outer ball bearing races 62 and 64 (FIG. 3) and 76 and 78 (FIG. 4) also reduces the rocking motion, side thrust or lateral movement imparted to the bellows along with the upward movement as compared to the prior art eccentric drives even when the shafts 22 and 24 are rotated in the same directions of rotation. Thus decreased wear of the bellows and increase life of the Stirling cycle machine may be achieved in accordance with the further teachings of the present invention wherein the shafts 22 and 24 are rotated in the same directions of rotation. Rotation of the shafts 22 and 24 in the same directions of rotation may be accomplished by mounting a pulley on the front end of the shaft 22 (FIG. 1) and by surrounding this pulley and pulley 33 with the drive belt 34.

It will be still further understood that many variations and modifications may be made in the present invention without departing from the spirit and the scope thereof.

What is claimed is:

1. In a Stirling cycle machine including first and second variable-volume, compression-expansion chambers containing a gas a regenerator interconnecting the chambers and for conducting the gas therebetween, and eccentric drive means for driving the first and second chambers wherein the improvement comprises:

said eccentric drive means comprising a pair of rotatably mounted shafts, at least one pair of eccentric disks fixed on said shafts in phase with each other, and means for causing said shafts and thereby said eccentric disks to rotate in opposite directions.

2. In a Stirling cycle machine including a first bellows defining a variable-volume compression chamber, a second bellows defining a variable-volume expansion chamber, a regenerator interconnecting said chambers and for conducting a gas therebetween, and eccentric drive means for imparting at least upward movement to said first and second bellows, said drive having at least a tendency to also impart lateral movement to said first and second bellows during said upward movement, wherein the improvement comprises:

(a) said eccentric drive means comprising:

(i) a pair of rotatably mounted shafts;

(ii) two pairs of eccentric disks, each pair of eccentric disks fixed respectively on said shafts, the disks of each pair being fixed on said shafts in phase with each other and said pairs of disks being fixed on said shafts a predetermined number of degrees out of phase with each other; and (b) means for causing said shafts and thereby said eccentric disks of each pair to rotate in predetermined directions of rotation to cause said pairs of eccentric disks to respectively impart upward movement to said respective bellows with a reduced tendency to impart said lateral movement to said bellows to thereby reduce the tendency of said bellows to wear upon repeated upward movement thereof.

3. An improved Stirling cycle machine comprising:

first bellows defining a variable-volume compression chamber;

second bellows defining a variable-volume expansion chamber;

a regenerator interconnecting said chambers and for conducting a gas therebetween;

a pair of rotatably mounted shafts;

first and second pairs of eccentric disks, the eccentric disks of each pair being fixed on said shafts in phase with each other and said pairs of disks being fixed on said shafts a predetermined number of degrees out of phase with each other; and means for causing said shafts to rotate in predetermined directions of rotation to thereby cause the eccentric disks of said first and second pairs to rotate in predetermined directions of rotation and respectively impart upward movement to said first and second bellows with a reduced tendency of also imparting lateral movement to said bellows with said upward movement to thereby decrease the wear of said bellows upon repeated upward movement.

4. An improved Stirling cycle machine for cooling an object, comprising:

first bellows defining a variable-volume compression chamber;

second bellows defining a variable-volume expansion chamber;

each of said bellows having a fixed end and a movable end;

a regenerator interconnecting said chambers and for conducting a gas therebetween, said regenerator having a hot end and a cold end;

a cold transfer plate for transferring cold to said object for cooling;

to enhance accessibility of said cold transfer plate, said first and second bellows mounted parallel to each other, said fixed end of said second bellows and said cold end of said regenerator connected to said cold transfer plate and said hot end of said regenerator connected to said fixed end of said first bellows;

a pair of rotatably mounted shafts;

first and second pairs of eccentric disks, the eccentric disks of each pair being fixed on said shafts in phase with each other and said pairs of disks being fixed on said shafts a predetermined number of degrees out of phase with each other; and means for causing said shafts to rotate in predetermined directions of rotation to thereby cause the eccentric disks of said first and second pairs to rotate in predetermined directions of rotation and respectively impart upward movement to said movable ends of said first and second bellows with a reduced tendency of also imparting lateral movement to said movable ends of said bellows with upward movement to decrease the tendency of said bellows to wear upon repeated upward movement.

5. An improved Stirling cycle machine for cooling an object, comprising:

first bellows defining a variable-volume compression chamber;

second bellows defining a variable-volume expansion chamber;

each of said bellows having a fixed end and a movable end;

a regenerator interconnecting said chambers and for conducting a gas therebetween, said regenerator having a hot end and a cold end;

a cold transfer plate for transferring cold to said object for cooling; and to enhance accessibility of said cold transfer plate, said first and second bellows mounted parallel to each other, said fixed end of said second bellows and said cold end of said regenerator connected to said cold transfer plate and said hot end of said regenerator connected to said fixed end of said first bellows.

6. The Stirling cycle machine according to claim 2, 3 or 4 wherein said predetermined number of degrees is 90°.

7. The Stirling cycle machine according to claim 2, 3 or 4 wherein said predetermined directions of rotation are the opposite directions of rotation.

8. The Stirling cycle machine according to claim 2, 3 or 4 wherein said predetermined directions of rotation are the same directions of rotation.

9. The Stirling cycle machine according to claim 2, 3 or 4 wherein said eccentric disks are surrounded by ball bearing assemblies each including inner and outer races and wherein said outer races engage said bellows with reduced friction and further reduce said tendency to impart lateral movement to said bellows.

* * * * *